US011994146B2

(12) United States Patent
Huang et al.

(10) Patent No.: US 11,994,146 B2
(45) Date of Patent: May 28, 2024

(54) FAN DEVICE

(71) Applicant: GIGA-BYTE TECHNOLOGY CO., LTD., New Taipei (TW)

(72) Inventors: Shun-Chih Huang, New Taipei (TW); Tai-Chuan Mao, New Taipei (TW); Huan-Zhong Chen, New Taipei (TW); Chun-Liang Guo, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/992,856

(22) Filed: Nov. 22, 2022

(65) Prior Publication Data

US 2023/0184259 A1 Jun. 15, 2023

(30) Foreign Application Priority Data

Dec. 14, 2021 (TW) ..... 110146827

(51) Int. Cl.
*F04D 29/38* (2006.01)
*F04D 19/00* (2006.01)
*F04D 29/32* (2006.01)

(52) U.S. Cl.
CPC ..... *F04D 29/388* (2013.01); *F04D 19/002* (2013.01); *F04D 29/325* (2013.01); *F04D 29/386* (2013.01)

(58) Field of Classification Search
CPC .... F04D 29/325; F04D 29/384; F04D 29/386; F04D 29/388; F04D 19/002
See application file for complete search history.

(56) References Cited

U.S. PATENT DOCUMENTS 11,549,519 B1 * 1/2023 Wang ..... F04D 29/326
2015/0050133 A1 * 2/2015 Jiang ..... F04D 29/664 415/183

(Continued)

FOREIGN PATENT DOCUMENTS

CN 104564819 A * 4/2015
CN 109469643 A * 3/2019 ..... F04D 19/002

OTHER PUBLICATIONS

Mark McGrouther, Jul. 3, 2019, Australian Museum https://australian.museum/learn/animals/fishes/placoid-scales/#:~:text=Placoid%20scales%20are%20found%20in,often%20referred%20to%20as%20denticles. (Year: 2019).*

(Continued)

*Primary Examiner* — Topaz L. Elliott
*Assistant Examiner* — Ryan C Clark
(74) *Attorney, Agent, or Firm* — Idea Intellectual Limited; Margaret A. Burke; Sam T. Yip

(57) ABSTRACT

A fan device includes a hub and a plurality of fan blades. Each of the fan blades includes a driving surface, and the driving surface includes a first tooth column and a second tooth column. The first tooth column includes a plurality of first skin-tooth units. Each of the first skin-tooth units includes a first body. A first middle ridge and two first side ridges protrude from a surface of the first body, and a groove is formed between two adjacent first skin-tooth units. The second tooth column includes a plurality of second skin-tooth units. Each of the second skin-tooth units includes a second body and an extension element. A second middle ridge and two second side ridges protrude from a surface of the second body, and the extension element is located in the groove and includes an extension rib.

10 Claims, 5 Drawing Sheets

(56) References Cited

U.S. PATENT DOCUMENTS

| | | | | |
|---|---|---|---|---|
| 2016/0177968 | A1* | 6/2016 | Gebert | F04D 29/384<br>416/236 R |
| 2017/0261000 | A1* | 9/2017 | Komura | F04D 29/384 |
| 2018/0030996 | A1* | 2/2018 | Schilling | F04D 29/388 |
| 2018/0080468 | A1* | 3/2018 | Kim | F04D 29/329 |
| 2018/0087784 | A1* | 3/2018 | Sawada | F04D 29/181 |
| 2019/0301471 | A1* | 10/2019 | Wang | F04D 29/384 |
| 2020/0224669 | A1* | 7/2020 | Hung | F04D 19/002 |
| 2022/0119097 | A1* | 4/2022 | Lyu | F03D 1/0633 |
| 2022/0178558 | A1* | 6/2022 | Park | F04D 29/384 |

OTHER PUBLICATIONS

"Abby", Sep. 25, 2015, Fishionary https://fishionary.fisheries.org/placoid-denticles/ (Year: 2015).*

April Reese, May 15, 2014, Discover Magazine https://www.discovermagazine.com/technology/3-d-printed-shark-skin-boosts-swimming-speeds (Year: 2014).*

* cited by examiner

FAN DEVICE

CROSS-REFERENCE TO RELATED APPLICATION

This non-provisional application claims priority under 35 U.S.C. § 119(a) to Patent Application No. 110146827 in Taiwan, R.O.C. on Dec. 14, 2021, the entire contents of which are hereby incorporated by reference.

TECHNICAL FIELD

The present invention relates to a heat dissipation device, and in particular, to a fan device.

BACKGROUND OF THE INVENTION

Generally, the temperature of electronic elements installed in electronic devices will gradually increase with the operation time. In order to prevent the high temperature from affecting the performance and life of the electronic elements, the electronic devices are often equipped with cooling fans, so as to drive the air to flow through the rotation of the cooling fans, thereby dissipating heat of the electronic elements.

With the rapid development of electronic industry, increasingly high requirements are imposed on performance of the electronic element, so that the temperature of electronic element is higher during operation. Therefore, the rotational speed and an air volume of the cooling fan need to be simultaneously increased to improve the cooling effect. However, with the increase in the rotational speed and the air volume of the cooling fan, the noise generated by the fan during operation is also louder, which affects the feeling in use. However, at present, fan blades of the cooling fan mostly adopt smooth surfaces, which does not help to improve the noise problem of the cooling fan.

SUMMARY OF THE INVENTION

In view of the above, in an embodiment, a fan device is provided, including a hub and a plurality of fan blades. The hub includes a central shaft and an outer periphery. The outer periphery surrounds the central shaft. The plurality of fan blades are arranged on an outer periphery at equal angles. Each of the fan blades extends in a direction away from the central shaft. The each fan blade includes a driving surface, and the driving surface includes a first tooth column and a second tooth column. The first tooth column includes a plurality of first skin-tooth units. The plurality of first skin-tooth units are arranged side by side in the direction away from the central shaft. Each of the first skin-tooth units includes a first body. A first middle ridge and two first side ridges protrude from a surface of the first body. Two first flow directing channels are formed between the first middle ridge and the two first side ridges, and a groove is formed between two adjacent first skin-tooth units. The second tooth column includes a plurality of second skin-tooth units. The plurality of second skin-tooth units are arranged side by side in the direction away from the central shaft. Each of the second skin-tooth units includes a second body and an extension element. A second middle ridge and two second side ridges protrude from a surface of the second body. Two second flow directing channels are formed between the second middle ridge and the two second side ridges. The extension element is located in the groove and includes an extension rib. One end of the extension rib is connected to the second middle ridge, and an other end of the extension rib extends to a position between two adjacent first side ridges of the two adjacent first skin-tooth units.

Based on the above, according to the fan device of the embodiment of the present invention, by arranging a plurality of tooth columns on the driving surface of the fan blades, the airflow can be cut by each skin-tooth unit in the tooth columns and flow into the flow directing channel of the each skin-tooth unit to form a vortex, so as to achieve the effects of flow directing and reducing wind resistance and greatly reduce the noise of the fan device in use. In addition, through the arrangement of the extension rib of each second skin-tooth unit, the airflow can be guided to smoothly enter the flow directing channels of different columns of skin-tooth units, so that the airflow can be subjected to resistance reduction for many times and the noise of the fan device in use can be further reduced.

BRIEF DESCRIPTION OF THE DRAWINGS

The disclosure will become more fully understood from the detailed description given herein below for illustration only, and thus not limitative of the disclosure, wherein.

DETAILED DESCRIPTION OF THE INVENTION

Figure 1:
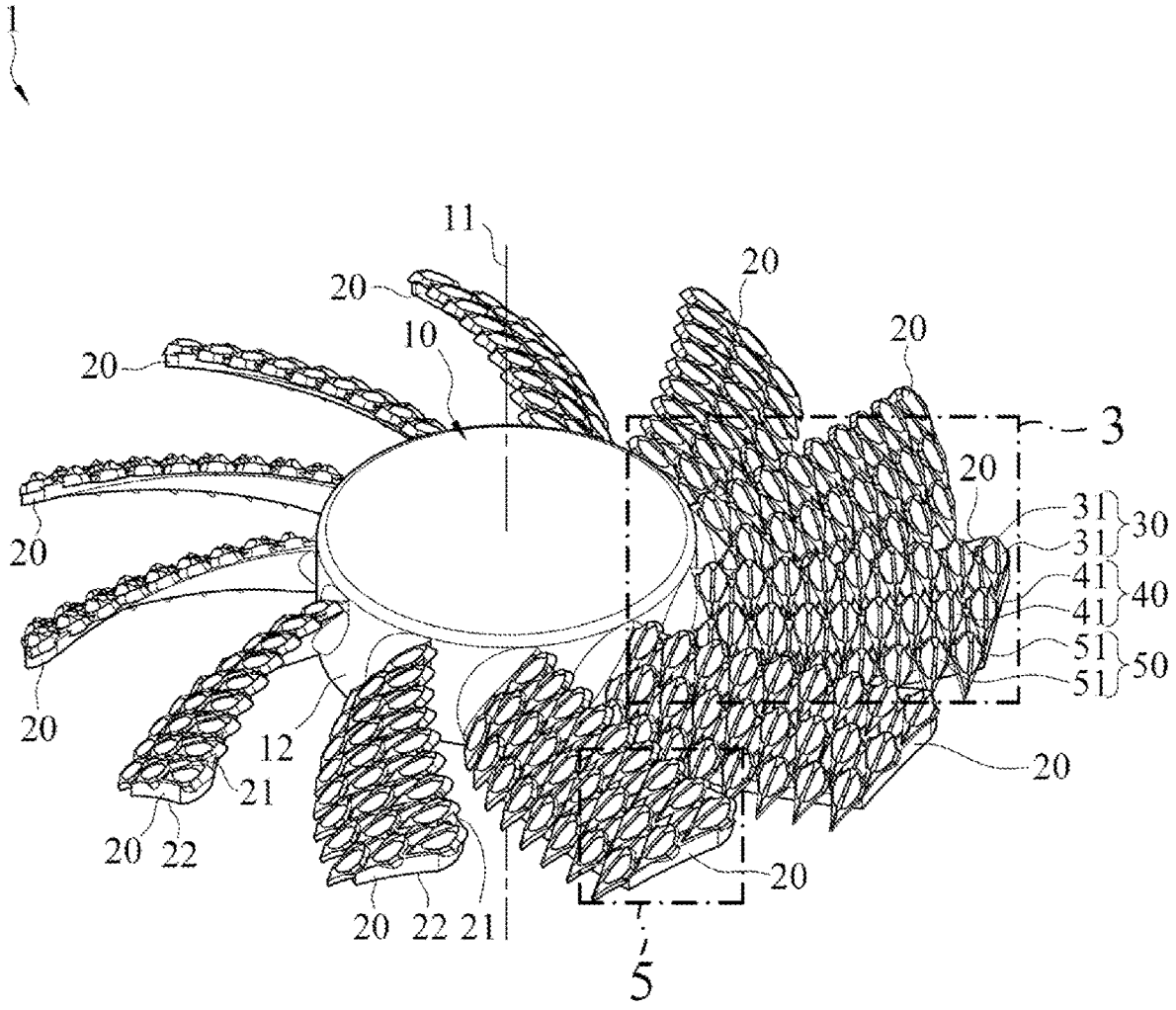
FIG. 1 is a three-dimensional view of an embodiment of a fan device according to the present invention.
Figure 2:
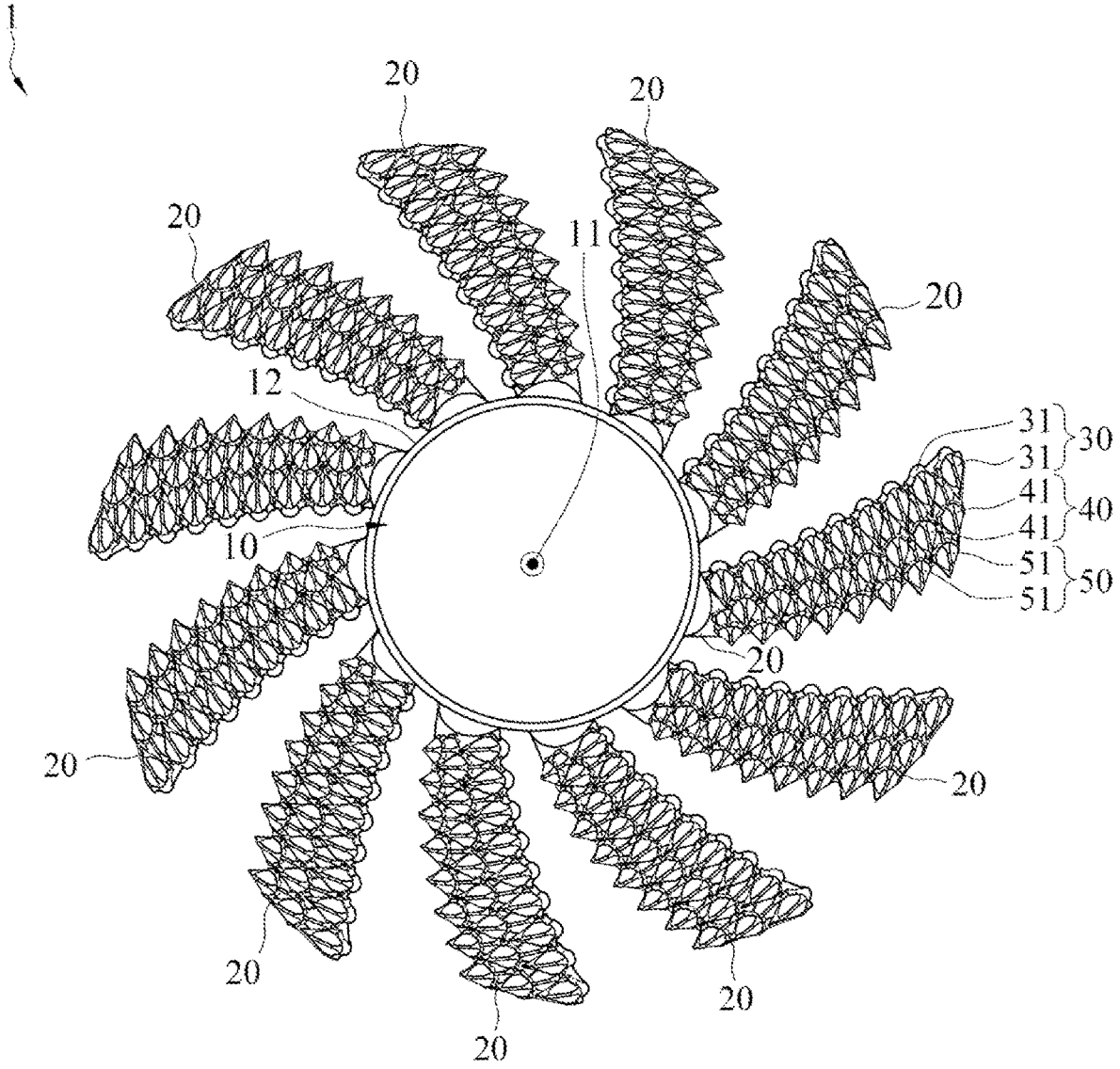
FIG. 2 is a side view of an embodiment of a fan device according to the present invention.

FIG. 1 is a three-dimensional view of an embodiment of a fan device according to the present invention. FIG. 2 is a side view of an embodiment of a fan device according to the present invention. As shown in FIG. 1 and FIG. 2, the fan device 1 includes a hub 10 and a plurality of fan blades 20. The fan device 1 may be installed on various electronic products. For example, the electronic products may be computers, servers, or household appliances, to dissipate heat of heating elements installed in the electronic products.

As shown in FIG. 1 and FIG. 2, the hub 10 includes a central shaft 11 and an outer periphery 12. The outer periphery 12 surrounds the central shaft 11. The hub 10 is configured to be connected to a driving element (such as a motor) to drive the hub 10 to rotate around the central shaft 11 through the driving element.

As shown in FIG. 1 and FIG. 2, the plurality of fan blades 20 are arranged on the outer periphery 12 of the hub 10 at equal angles, and each of the fan blades 20 extends away from the central shaft 11. When the hub 10 is driven to rotate, the plurality of fan blades 20 can be driven to rotate synchronously to drive air to flow, so as to dissipate heat of the heating elements. A number of fan blades 20 may be more than two, depending on actual product requirements. For example, in this embodiment, the number of fan blades 20 is 11, and the fan blades are arranged at equal angles (by about 32.7° at this angle) around the central shaft 11 of the hub 10.

In some embodiments, the each fan blade 20 and the hub 10 may be integrally formed (as shown in FIG. 1 and FIG. 2). For example, the each fan blade 20 and the hub 10 may be integrally formed by injection molding or casting. Alternatively, the each fan blade 20 and the hub 10 may also be an assembled structure. For example, the each fan blade 20 may be assembled to the outer periphery 12 of the hub 10 by adhesion, engagement, or welding, which is not limited in the present invention.

Figure 3:
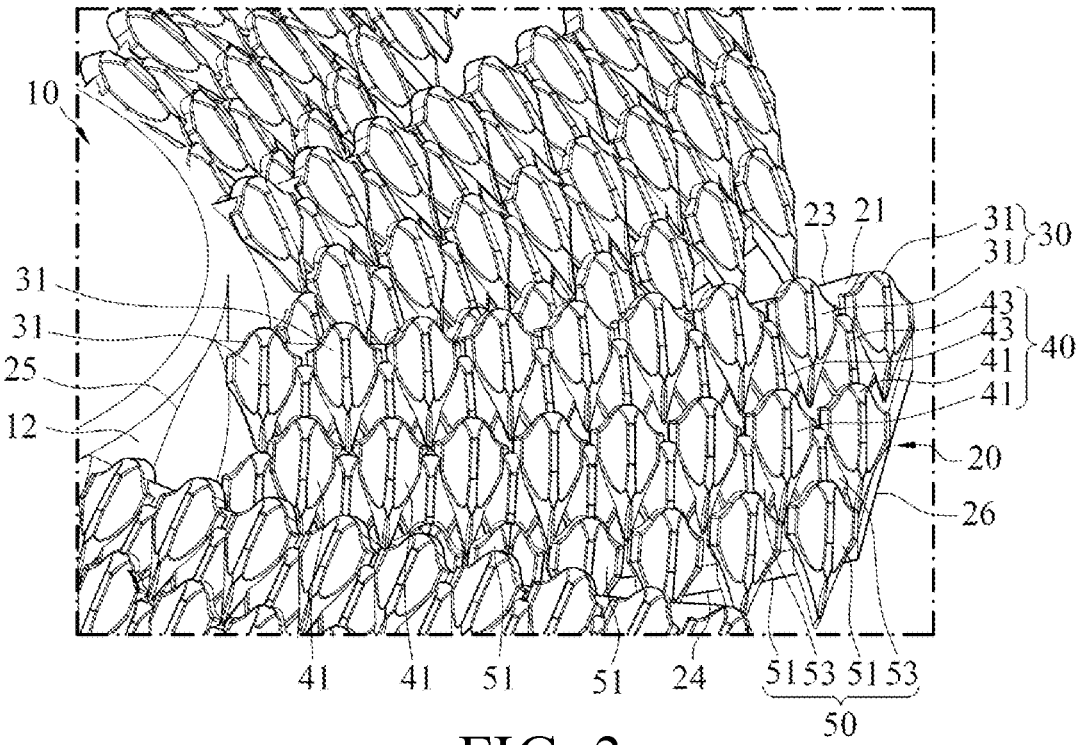
FIG. 3 is a partial three-dimensional view of an embodiment of a fan device according to the present invention.

FIG. 3 is a partial three-dimensional view of an area 3 of FIG. 1. As shown in FIG. 1 to FIG. 3, the each fan blade 20 includes a driving surface 21 and a leeward surface 22. The driving surface 21 and the leeward surface 22 are respectively two opposite surfaces of the each fan blade 20. In addition, in this embodiment, the each fan blade 20 is a long plate and includes a first side edge 23, a second side edge 24, a third side edge 25, and a fourth side edge 26. The first side edge 23 and the second side edge 24 are two opposite long sides of the fan blade 20. The first side edge 23 and the second side edge 24 respectively extend away from the central shaft 11. The third side edge 25 and the fourth side edge 26 are two opposite short sides of the fan blade 20. The third side edge 25 is connected to the outer periphery 12 of the hub 10, and the fourth side edge 26 is far away from the outer periphery 12 relative to the third side edge 25. However, the above embodiments are merely examples, and in some embodiments, the fan blades 20 may also be plates with other shapes (such as square, oval, or other irregular shapes).

Figure 4:
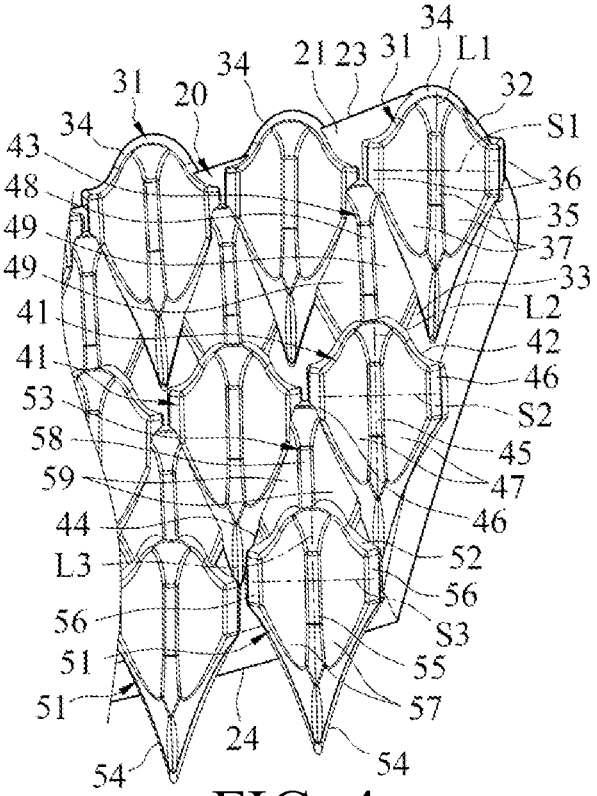
FIG. 4 is a partial plan view of a fan blade of an embodiment of a fan device according to the present invention.

FIG. 4 is a partial plan view of a fan blade of an embodiment of a fan device according to the present invention. Referring to FIG. 3 and FIG. 4, the driving surface 21 of the each fan blade 20 includes at least two tooth columns. For example, in this embodiment, the driving surface 21 of the each fan blade 20 includes three tooth columns (a first tooth column 30, a second tooth column 40, and a third tooth column 50), which is not limited thereto. The driving surface 21 may also include two tooth columns or more than four tooth columns, depending on a size of the each fan blade 20.

As shown in FIG. 2 to FIG. 4, the first tooth column 30 on the driving surface 21 of the fan blade 20 includes a plurality of first skin-tooth units 31, the second tooth column 40 includes a plurality of second skin-tooth units 41, and the third tooth column 50 includes a plurality of third skin-tooth units 51. The plurality of first skin-tooth units 31, the plurality of second skin-tooth units 41, and the plurality of third skin-tooth units 51 are respectively arranged side by side in a direction away from the central shaft 11 of the hub 10 (that is, a direction of the third side edge 25 toward the fourth side edge 26). The first tooth column 30, the second tooth column 40, and the third tooth column 50 are further arranged in a plurality of columns from the first side edge 23 to the second side edge 24, so that the second tooth column 40 is located between the first tooth column 30 and the third tooth column 50, the first tooth column 30 is adjacent to the first side edge 23 relative to the second tooth column 40, and the third tooth column 50 is adjacent to the second side edge 24 relative to the second tooth column 40.

In some embodiments, the fan blade 20, the first tooth column 30, the second tooth column 40, and the third tooth column 50 may be integrally formed (as shown in FIG. 1 and FIG. 2). For example, the fan blade 20, the first tooth column 30, the second tooth column 40, and the third tooth column 50 may be integrally formed by injection molding or casting.

Figure 5:
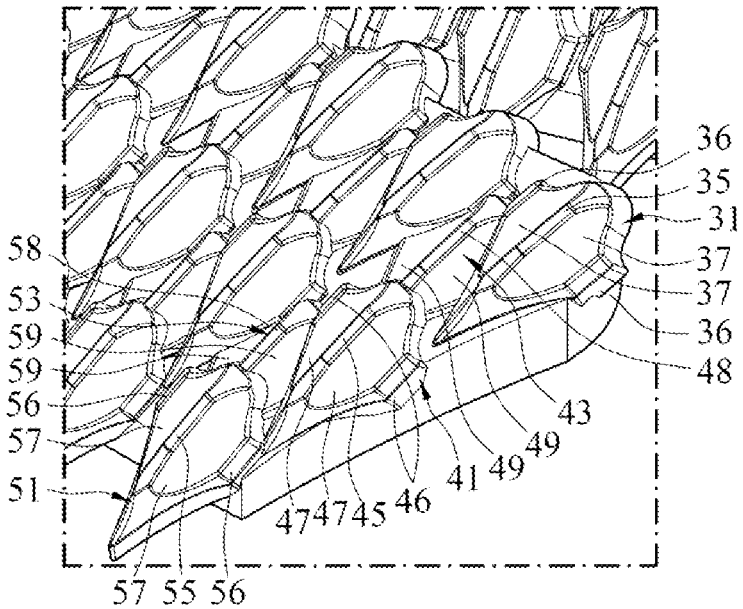
FIG. 5 is another partial three-dimensional view of an embodiment of a fan device according to the present invention.

FIG. 5 is a partial three-dimensional view of an area 5 of FIG. 1. As shown in FIG. 3 to FIG. 5, each of the first skin-tooth units 31 in the first tooth column 30 includes a first body 32, and a first middle ridge 35 and two first side ridges 36 protrude from a surface of the first body 32. The first middle ridge 35 and each of the first side ridges 36 extend from the first side edge 23 toward the second side edge 24, and the first middle ridge 35 is located between the two first side ridges 36 and arranged in parallel with each other, so that two concave first flow directing channels 37 are respectively formed between the first middle ridge 35 and the two first side ridges 36.

As shown in FIG. 3 to FIG. 5, in this embodiment, the first body 32 is kite-shaped and has a long axis L1 and a short axis S1 perpendicular to each other. The long axes L1 of the first bodies 32 of the first skin-tooth units 31 are parallel to each other, so that a plurality of first skin-tooth units 31 are arranged side by side. The first middle ridge 35 on the first body 32 is arranged along the long axis L1, and the two first side ridges 36 are respectively arranged on two opposite ends of the short axis S1, and a length of the first middle ridge 35 is greater than a length of each of the first side ridges 36. Herein, the length of the first middle ridge 35 is twice the length of the first side ridge 36, which is not limited thereto.

In addition, as shown in FIG. 3 to FIG. 5, since the first body 32 of the each first skin-tooth unit 31 is kite-shaped, a groove 33 is formed between two adjacent first skin-tooth units 31. For example, in this embodiment, a triangular groove 33 is formed between two adjacent oblique sides of the two adjacent first skin-tooth units 31 and two adjacent first side ridges 36.

As shown in FIG. 3 to FIG. 5, each of the second skin-tooth units 41 in the second tooth column 40 includes a second body 42 and an extension element 43. A structure of the second body 42 may be the same as or similar to the structure of the first body 32. For example, in this embodiment, a second middle ridge 45 and two second side ridges 46 also protrude from a surface of the second body 42. The second middle ridge 45 and each of the second side ridges 46 extend from the first side edge 23 facing the second side edge 24, and the second middle ridge 45 is located between the two second side ridges 46 and arranged in parallel with each other, so that two concave second flow directing channels 47 are respectively formed between the second middle ridge 45 and the two second side ridges 46.

As shown in FIG. 3 to FIG. 5, in this embodiment, the second body 42 is also kite-shaped and has a long axis L2 and a short axis S2 perpendicular to each other. The long axes L2 of the second bodies 42 of the second skin-tooth units 41 are parallel to each other, so that a plurality of second skin-tooth units 41 are arranged side by side. The second middle ridge 45 on the second body 42 is arranged along the long axis L2, and the two second side ridges 46 are respectively arranged on two opposite ends of the short axis S2, and a length of the second middle ridge 45 is greater than a length of each of the second side ridges 46. Herein, the length of the second middle ridge 45 is twice the length of the second side ridge 46, which is not limited thereto.

As shown in FIG. 3 to FIG. 5, in this embodiment, the plurality of first skin-tooth units 31 and the plurality of second skin-tooth units 41 are staggered, so that each of the second skin-tooth units 41 corresponds to the groove 33 formed between two adjacent first skin-tooth units 31, and the extension element 43 of each of the second skin-tooth units 41 is located in the groove 33. Herein, the extension element 43 includes an extension rib 48. The extension rib 48 protrudes from the driving surface 21 of the fan blade 20. One end of the extension rib 48 is connected to the second middle ridge 45 of the second body 42, and an other end of the extension rib 48 extends to a position between two adjacent first side ridges 36 of the two adjacent first skin-tooth units 31.

Figure 6:
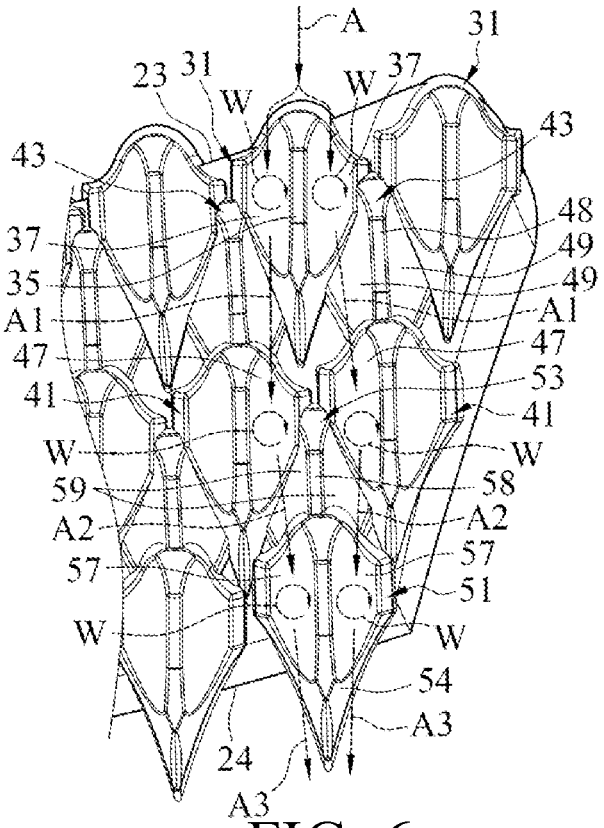
FIG. 6 is a schematic diagram of flow directing of an embodiment of a fan device according to the present invention.

Therefore, referring to FIG. 3, FIG. 4, and FIG. 6, in the fan device 1 according to the embodiment of the present invention, a plurality of tooth columns (such as the first tooth column 30 and the second tooth column 40) on the driving surface 21 of the fan blades 20. When the hub 10 rotates to drive the plurality of fan blades 20 to rotate, an airflow A (as shown in FIG. 6) flowing from the first side edge 23 of each of the fan blades 20 can be cut by the first middle ridge 35 of the each first skin-tooth unit 31 and introduced into the two first flow directing channels 37 of the each first skin-tooth unit 31 to form a vortex W. In this way, the airflow A changes from a state of sliding friction to a state of rolling friction, so as to reduce wind resistance and preventing external air from re-entering gaps of the fan blades 20, so that the gaps of the fan blades 20 are filled with low-speed and quiet airflow, thereby greatly reducing the noise of the fan device 1 during operation.

In addition, as shown in FIG. 6, through the arrangement of the extension ribs 48 of the each second skin-tooth unit 41, the airflow A1 flowing out of the each first flow directing channel 37 toward the second side edge 24 can be guided by the extension ribs 48 to smoothly enter the second flow directing channel 47 of the each second skin-tooth unit 41 in the second tooth column 40, so that the airflow A1 can form a vortex W in the second flow directing channel 47, thereby reducing the wind resistance again and further reducing the noise of the fan device 1 in use.

As shown in FIG. 3 to FIG. 5 again, each of the third skin-tooth units 51 in the third tooth column 50 includes a third body 52 and an extension element 53. A structure of the third body 52 may be the same as or similar to the structure of the first body 32. For example, in this embodiment, a third middle ridge 55 and two third side ridges 56 also protrude from a surface of the third body 52. The third middle ridge 55 and each of the third side ridges 56 extend from the first side edge 23 toward the second side edge 24, and the third middle ridge 55 is located between the two third side ridges 56 and arranged in parallel with each other, so that two concave third flow directing channels 57 are respectively formed between the third middle ridge 55 and the two third side ridges 56.

As shown in FIG. 3 to FIG. 5, in this embodiment, the third body 52 is also kite-shaped and has a long axis L3 and a short axis S3 perpendicular to each other. The long axes L3 of the third bodies 52 of the third skin-tooth units 51 are parallel to each other, so that a plurality of third skin-tooth units 51 are arranged side by side. The third middle ridge 55 is arranged along the long axis L3, and the two third side ridges 56 are respectively arranged on two opposite ends of the short axis S3, and a length of the third middle ridge 55 is greater than a length of each of the third side ridges 56. Herein, the length of the third middle ridge 55 is twice the length of the third side ridge 56, which is not limited thereto.

As shown in FIG. 3 to FIG. 5, since the second body 42 of the each second skin-tooth unit 41 is kite-shaped, a groove 44 is formed between two adjacent second skin-tooth units 41. For example, in this embodiment, a triangular groove 44 is formed between two adjacent oblique sides of the two adjacent second skin-tooth units 41 and two adjacent second side ridges 46.

As shown in FIG. 3 to FIG. 5, the plurality of third skin-tooth units 51 and the plurality of second skin-tooth units 41 are staggered, so that each of the third skin-tooth units 51 corresponds to the groove 44 formed between two adjacent second skin-tooth units 41, and the extension element 53 of each of the third skin-tooth units 51 is located in the groove 44. Herein, the extension element 53 includes an extension rib 58. The extension rib 58 protrudes from the driving surface 21 of the fan blade 20. One end of the extension rib 58 is connected to the third middle ridge 55 of the third body 52, and an other end of the extension rib 58 extends to a position between two adjacent second side ridges 46 of the two adjacent second skin-tooth units 41.

In this way, as shown in FIG. 6, through the arrangement of the third tooth column 50 and the extension ribs 58, an airflow A2 flowing out of the each second flow directing channel 47 toward the second side edge 24 can be guided by the extension ribs 58 to smoothly enter the third flow directing channel 57 of the each third skin-tooth unit 51 in the third tooth column 50, so that the airflow A2 can form a vortex W in the third flow directing channel 57, thereby reducing the wind resistance for a plurality of times and further reducing the noise of the fan device 1 in use.

In some embodiments, the first body 32 of the each first skin-tooth unit 31, the second body 42 of the each second skin-tooth unit 41, and the third body 52 of the each third skin-tooth unit 51 may also be in the shape of other polygons, which is not limited to the shape of a kite. For example, the polygon may be a triangle, a diamond, a pentagon, or the like.

As shown in FIG. 3 to FIG. 5, in this embodiment, the extension element 43 of the each second skin-tooth unit 41 further includes two flow directing grooves 49. The two flow directing grooves 49 are respectively located at two opposite sides of the extension rib 48, and the two flow directing grooves 49 are in communication with the two second flow directing channel 47 of the second skin-tooth unit 41 and the two adjacent first flow directing channel 37 of the two adjacent first skin-tooth units 31. That is to say, the flow directing grooves 49 of the extension element 43 is connected between the first flow directing channel 37 and the second flow directing channel 47, so that the airflow A1 flowing out of the first flow directing channel 37 toward the second side edge 24 can smoothly enter the second flow directing channel 47 through the guide of the flow directing grooves 49, thereby further reducing the wind resistance.

As shown in FIG. 3 to FIG. 5, in this embodiment, the extension element 53 of the each third skin-tooth unit 51 also includes two flow directing grooves 59. The two flow directing grooves 59 are respectively located at two opposite sides of the extension rib 58, and the two flow directing grooves 59 are in communication with the two third flow directing channel 57 of the third skin-tooth unit 51 and the two adjacent second flow directing channel 47 of the two adjacent second skin-tooth units 41. That is to say, the flow directing grooves 59 of the extension element 53 is connected between the second flow directing channel 47 and the third flow directing channel 57, so that the airflow A2 flowing out of the second flow directing channel 47 toward the second side edge 24 can smoothly enter the third flow directing channel 57 through the guide of the flow directing grooves 59, thereby further reducing the wind resistance.

As shown in FIG. 4 again, in this embodiment, the first body 32 of the each first skin-tooth unit 31 further has a protrusion 34, and the protrusion 34 protrudes from the first side edge 23 of the fan blade 20. Therefore, referring to FIG. 6, the airflow A entering from the first side edge 23 of the each fan blade 20 can obtain a better cutting effect based on the protrusion 34. In addition, in this embodiment, an edge of the protrusion 34 protruding from the first side edge 23 is a curved edge (which is an arcuate curve herein), so that the airflow A can be guided by the curved edge after being cut to smoothly enter the two first flow directing channels 37 of the each first skin-tooth unit 31, thereby further improving the flow directing.

As shown in FIG. 4 and FIG. 5, in this embodiment, the third body 52 of the third skin-tooth unit 51 further has a protrusion 54, and the protrusion 54 protrudes from the second side edge 24 of the fan blade 20. Herein, the protrusion 54 is pointed to avoid blocking flowing of the airflow. In addition, as shown in FIG. 6, an airflow A3 can also be guided by the pointed protrusion 54 when flowing out of the third flow directing channel 57 of the third skin-tooth unit 51, so as to avoid generating uneven wake flow and further reduce noise.

Figure 7:
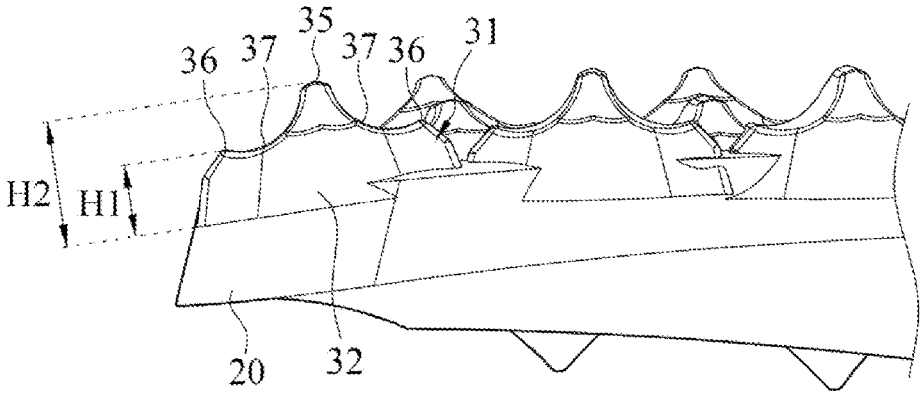
FIG. 7 is another partial plan view of a fan blade of an embodiment of a fan device according to the present invention.

FIG. 7 is another partial plan view of a fan blade of an embodiment of a fan device according to the present invention. As shown in FIG. 7, in this embodiment, a height H1 of a first side ridge 36 of the each first skin-tooth unit 31 is lower than a height H2 of a first middle ridge 35. The height H1 of the first side ridge 36 and the height H2 of the first middle ridge 35 may be heights by which the first side ridge 36 and the first middle ridge 35 respectively protrude from the surface of the first body 32. Therefore, as shown in FIG. 5 to FIG. 7, the first middle ridge 35 having a relatively large height can effectively isolate the airflow and direct the flow. In addition, the first side ridge 36 with a relatively small height can allow the vortex W formed in the first flow directing channel 37 to generate a better turbine rotation effect, thereby achieving a better effect of resistance reduction and noise reduction. In some embodiments, the height of the second side ridge 46 of the each second skin-tooth unit 41 may also be less than the height of the second middle ridge 45, and the height of the third side ridge 56 of the each third skin-tooth unit 51 may also be less than the height of the third middle ridge 55. The details are not described herein again.

Figure 8:
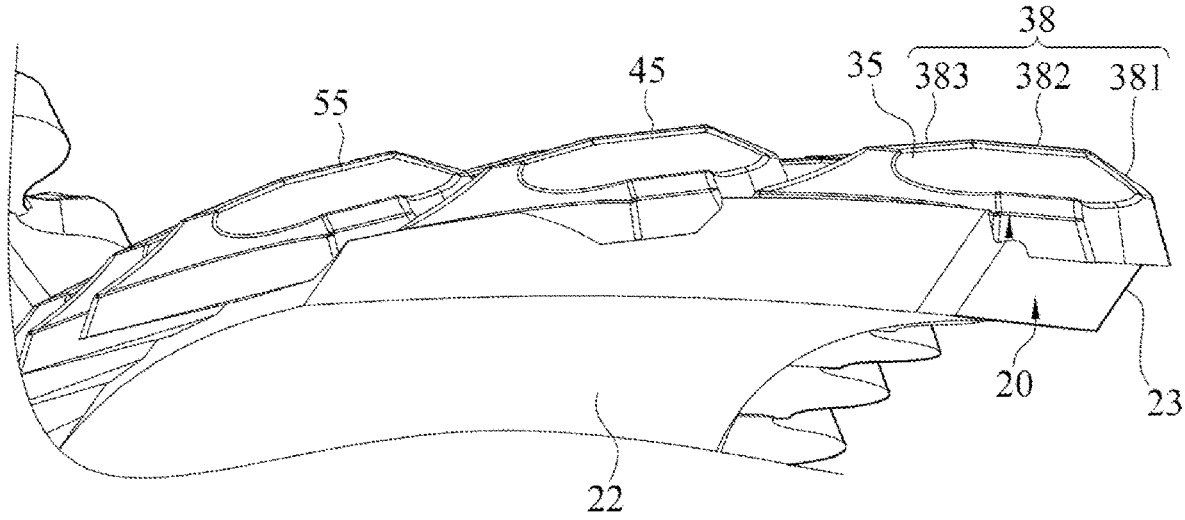
FIG. 8 is yet another partial plan view of a fan blade of an embodiment of a fan device according to the present invention.

FIG. 8 is still another partial plan view of a fan blade of an embodiment of a fan device according to the present invention. As shown in FIG. 8, in this embodiment, a first middle ridge 35 of each first skin-tooth unit 31 includes a top edge 38. The top edge 38 has a front edge 381, a middle section 382, and a rear edge 383. The middle section 382 is connected between the front edge 381 and the rear edge 383, and the front edge 381 is adjacent to a first side edge 23 of the fan blade 20 relative to the rear edge 383. Herein, the front edge 381 and the rear edge 383 are respectively inclined edges, and a height of the middle section 382 is respectively greater than a height of the front edge 381 and a height of the rear edge 383. That is to say, the top edge 38 of the first middle ridge 35 has a height variation (that is, the middle is high and two sides are low) rather than a uniform height, so as to improve the flow directing effect of the first middle ridge 35.

In some embodiments, a top edge of a second middle ridge 45 of each second skin-tooth unit 41 and a top edge of a third middle ridge 55 of each third skin-tooth unit 51 can also have the height variation with the first middle ridge 35 rather than a uniform height, so as to improve the flow directing effect of the second middle ridge 45 and the third middle ridge 55. The details are not described herein.

Based on the above, according to the fan device of the embodiment of the present invention, by arranging a plurality of tooth columns on the driving surface of the fan blades, the airflow can be cut by each skin-tooth unit in the tooth columns and flow into the flow directing channel of the each skin-tooth unit to form a vortex, so as to achieve the effects of flow directing and reducing wind resistance and greatly reduce the noise of the fan device in use. In addition, through the arrangement of the extension rib of each second skin-tooth unit, the airflow can be guided to smoothly enter the flow directing channels of different columns of skin-tooth units, so that the airflow can be subjected to resistance reduction for many times and the noise of the fan device in use can be further reduced.

What is claimed is:

1. A fan device, comprising:

a hub comprising a central shaft and an outer periphery, wherein the outer periphery surrounds the central shaft; and a plurality of fan blades arranged on the outer periphery at equal angles, wherein each of the fan blades extends in a direction away from the central shaft, each of the fan blades comprises a driving surface, and the driving surface comprises:

a first tooth column comprising a plurality of first skin-tooth units, wherein the first skin-tooth units are arranged side by side in the direction away from the central shaft, each of the first skin-tooth units comprises a first body, a first middle ridge and two first side ridges protrude from a surface of the first body, two first flow directing channels are formed between the first middle ridge and the two first side ridges, and a groove is formed between two adjacent first skin-tooth units; and a second tooth column comprising a plurality of second skin-tooth units, wherein the second skin-tooth units are arranged side by side in the direction away from the central shaft, each of the second skin-tooth units comprises a second body and an extension element, a second middle ridge and two second side ridges protrude from a surface of the second body, two second flow directing channels are formed between the second middle ridge and the two second side ridges, the extension element is located in the groove and comprises an extension rib, one end of the extension rib is connected to the second middle ridge, and an other end of the extension rib extends to a position between the two adjacent first side ridges of the two adjacent first skin-tooth units.

2. The fan device according to claim 1, wherein a height of each of the first side ridges is lower than a height of the first middle ridge.

3. The fan device according to claim 1, wherein the first body is kite-shaped and has a long axis and a short axis perpendicular to each other, the first middle ridge is arranged along the long axis, and the two first side ridges are located at two opposite ends of the short axis.

4. The fan device according to claim 1, wherein the first middle ridge comprises a top edge, the top edge has a front edge, a middle section, and a rear edge, the middle section is connected between the front edge and the rear edge, and a height of the middle section is respectively greater than a height of the front edge and a height of the rear edge.

5. The fan device according to claim 1, wherein the extension element further comprises two flow directing grooves, the two flow directing grooves are respectively located at two opposite sides of the extension rib, and the two flow directing grooves are in communication with the two second flow directing channels and the two adjacent first flow directing channels of the two adjacent first skin-tooth units.

6. The fan device according to claim 1, wherein each of the fan blades comprises a first side edge and a second side edge, the driving surface is located between the first side edge and the second side edge, the first tooth column is adjacent to the first side edge relative to the second tooth column, the first body of each of the first skin-tooth units has a protrusion, and the protrusion protrudes from the first side edge.

7. The fan device according to claim 6, wherein the protrusion has a curved edge.

8. The fan device according to claim 1, wherein the driving surface further comprises a third tooth column, the second tooth column is located between the first tooth column and the third tooth column, the third tooth column comprises a plurality of third skin-tooth units, the third skin-tooth units are arranged side by side in the direction away from the central shaft, each of the third skin-tooth units comprises a third body and an other extension element, a third middle ridge and two third side ridges protrude from a surface of the third body, two third flow directing channels are formed between the third middle ridge and the two third side ridges, an other groove is formed between two ends of two adjacent second skin-tooth units close to the third tooth column, the other extension element is located in the other groove and comprises an other extension rib, one end of the other extension rib is connected to the third middle ridge, and an other end of the other extension rib extends to a position between the two adjacent second side ridges of the two adjacent second skin-tooth units.

9. The fan device according to claim 8, wherein each of the fan blades comprises a first side edge and a second side edge, the driving surface is located between the first side edge and the second side edge, the third tooth column is adjacent to the second side edge relative to the second tooth column, the third body of each of the third skin-tooth units has a protrusion, and the protrusion protrudes from the second side edge.

10. The fan device according to claim 9, wherein the protrusion is pointed.

* * * * *